United States Patent [19]

Lazelle

[11] 4,246,624

[45] Jan. 20, 1981

[54] APPARATUS FOR REMOVING ELECTRO-STATIC CHARGE FROM AN AIRCRAFT WINDSCREEN

[75] Inventor: Brian D. Lazelle, Maulden, England

[73] Assignee: Lucas Industries Limited, Birmingham, England

[21] Appl. No.: 41,738

[22] Filed: May 23, 1979

[30] Foreign Application Priority Data

May 26, 1978 [GB] United Kingdom ..... 23379/78

[51] Int. Cl.[3] ..... H05F 3/00

[52] U.S. Cl. ..... 361/218; 244/1 A; 244/129.3; 361/212

[58] Field of Search ..... 361/212, 217, 218, 220, 361/221; 244/1 A, 129.3; 15/1.5 R, 97, 53 R, 103, 313

[56] References Cited

U.S. PATENT DOCUMENTS 3,904,929 9/1975 Kanaya et al. ..... 361/220

FOREIGN PATENT DOCUMENTS 482356 7/1962 U.S.S.R. ..... 15/313

435161 5/1972 U.S.S.R. ..... 244/129.3

OTHER PUBLICATIONS

"Conductive Coatings for Acrylic Plastics" Dept. of Comm., Office of Tech. Services Publication OTS 56-237 10/2/1956 361-220.

*Primary Examiner*—Harry E. Moose, Jr.

[57] ABSTRACT

Apparatus for removing electrostatic charge from an aircraft windscreen includes a conductive member arranged to be supported in contact with or in juxtaposition to the windscreen and connected to the aircraft "earth". If in contact, the member may be of conductive rubber. If juxtaposed, it may be of metal or other rigid material. The linkage supporting the member is arranged to allow it to be swept over the windscreen surface to clear an extended area thereof of charge.

9 Claims, 7 Drawing Figures

APPARATUS FOR REMOVING ELECTRO-STATIC CHARGE FROM AN AIRCRAFT WINDSCREEN

It is known that in certain conditions a large electrostatic charge can build up on an aircraft windscreen. Where the windscreen includes a conductive heater element, it has been found that the charge on the outer surface of the windscreen can break down the insulation of the screen material between this outer surface and the heating elements, causing damage to the windscreen material and to the heating elements and any control circuit associated with these elements.

It is an object of the present invention to provide a simple and convenient apparatus for removing electrostatic charge from the outer surface of an aircraft windscreen.

Apparatus in accordance with the invention comprises an electrically conductive member movably mounted on the aircraft structure and electrically earthed thereto, said conductive member being movable across the windscreen and being arranged to collect charge from the windscreen surface.

There may be on the conductive member electrically conductive means which may be a blade made of electrically conductive rubber or other flexible material such as fine wire brushes arranged to make direct contact with the windscreen.

Alternatively the conductive member may merely move in close proximity to the windscreen, the spacing between the conductive member and the windscreen being sufficiently small to ensure that the air gap will ionize at a voltage less than that required to cause insulation breakdown of the screen material.

Figure 1:
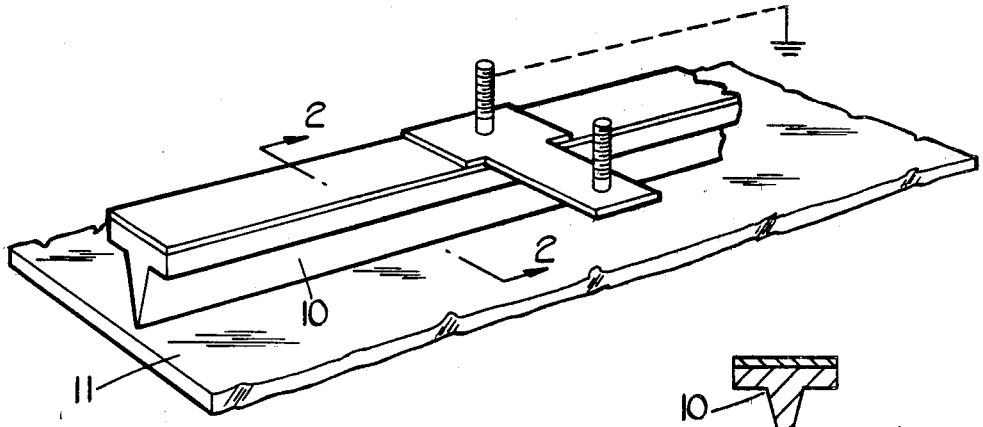
FIG. 1 is a diagrammatic perspective view of one example of apparatus in accordance with the invention.
Figure 2:
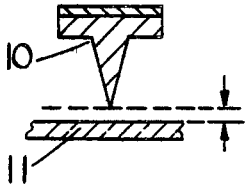
FIG. 2 is a section on line 2—2 in FIG. 1.

Referring firstly to FIGS. 1 and 2 the example shown includes a blade 10 of a conductive metal which is supported on a linkage (not shown) by means of which the blade 10 can be traversed across the windscreen 11. To prevent damage to the windscreen the blade 10, which is of knife-edged form is maintained in spaced relationship with the surface of the windscreen, the spacing being such that the air gap between the blade 10 and the screen 11 will ionize at a voltage less than that required to cause insulation breakdown of the windscreen material. The blade 10 is electrically connected by linkage to the aircraft frame so that when the airgap ionizes charge which has collected on the windscreen surface can pass to the frame.

Figure 3:
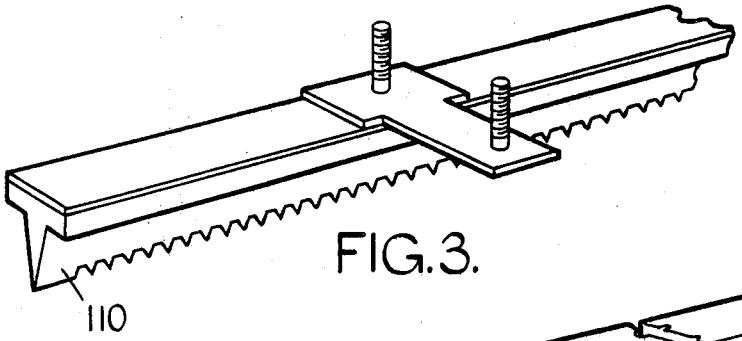
FIG. 3 is a view like FIG. 1 but showing a second example of the invention.

In the example shown in FIG. 3 the metal blade 110 is modified by having its knife-edge serrated so as to provide a series of sharply pointed projections. This arrangement improves the voltage discharge efficiency.

Figure 4:
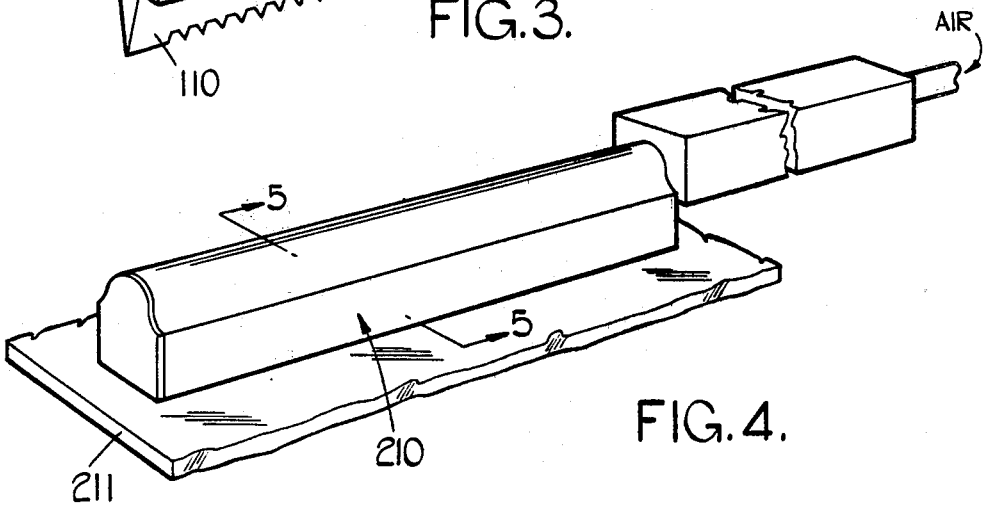
FIG. 4 is another view like FIG. 1 but showing a third example of the invention.
Figure 5:
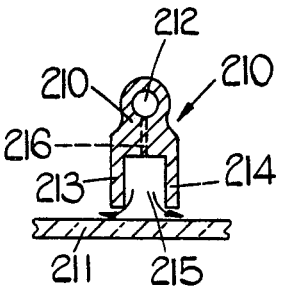
FIG. 5 is a section on line 5—5 in FIG. 4.

In the example shown in FIGS. 4 and 5, the blade 210 is formed of a conductive flexible material such as a flexible rubber or a conductive thermoplastic material.

As shown in FIG. 5, the blade has a spine portion in which there is formed an air passage 212. Depending from the spine portion are two skirt portions 213, 214 defining a void 215 connected to the passage 212, by a plurality of cross bores 216. In use pressurised air is supplied to the passage 212 and enters the void 215 via the bores 216. The air pressure in the void acts on the windscreen 211 and tends to lift the blade 210 away from the windscreen. This in turn causes air to leak from the void through the gaps between the margins of the skirts and the windscreen. Thus the blade tends to take up a position in which it is slightly lifted from the screen and acts, like the metal blade of FIG. 1, to conduct charge away from the surface of the screen across which it is swept by a linkage (not shown).

Figure 6:
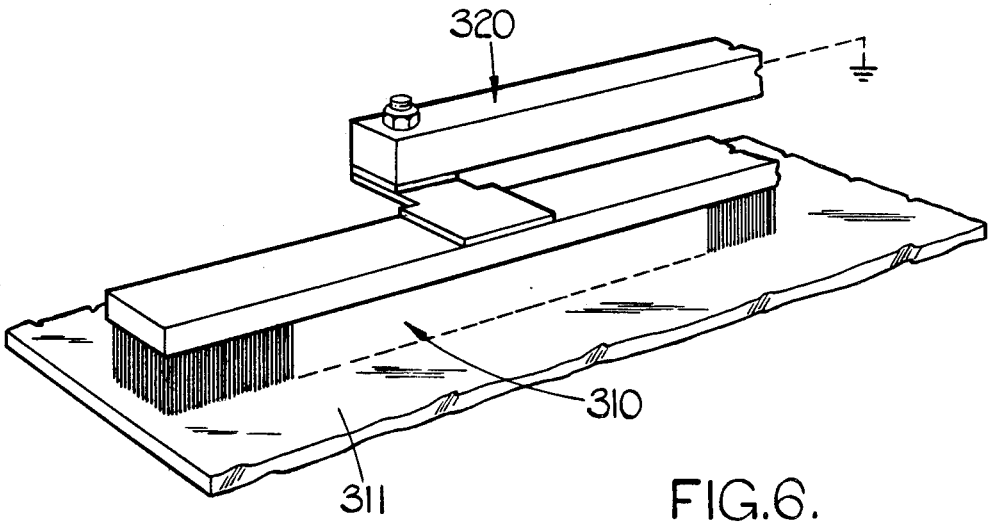
FIG. 6 is another view like FIG. 1, but showing a fourth example of the invention

Turning now to FIG. 6, the blade in this case is replaced by a brush 310 having conductive bristles, preferably formed of non-magnetic conductive fibres. The brush is supported on a linkage 320 such that it rests on the surface of the windscreen 311, the linkage providing an electrical connection to the aircraft frame.

In a modification of the example shown in FIG. 6, the brush 310 is supported with the tips of its bristles spaced from the windscreen.

Figure 7:
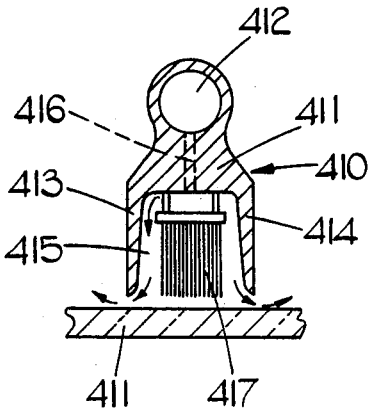
FIG. 7 is a section like FIG. 5, but showing a fifth example of the invention.

Finally the arrangements of FIGS. 4 and 5 and FIG. 6, may be combined as shown in FIG. 7. In this case the blade 410 with its spine 411 having an air passage 412 and skirt portions 413, 414 defining a void 415, supports a brush of conductive bristles 417 within the void. When pressurised air is supplied to the passage 412 the blade 410 lifts a controlled distance from the surface of the screen so that the tips of the bristles of the brush 417 can be swept over the screen without actually touching it. The blade 410 may be of conductive or insulating flexible material.

In the examples of the invention shown in FIGS. 4 and 5 and FIG. 7, the air supply may be ionized as is disclosed in U.K. Pat. No. 1,213,291.

I claim:

1. Apparatus for removing electrostatic charge from an aircraft windscreen comprising an electrically conductive member movably mounted on the aircraft structure and electrically earthed thereto, said conductive member being movable across the windscreen and being arranged to collect charge from the windscreen surface.

2. Apparatus as claimed in claim 1 further comprising conductive means of said conductive member, in the form of a blade of flexible conductive material arranged to make direct contact with the windscreen.

3. Apparatus as claimed in claim 2 in which said blade is formed of conductive rubber.

4. Apparatus as claimed in claim 2 in which said blade is formed of conductive thermoplastic material.

5. Apparatus as claimed in claim 1 further comprising a plurality of fine wire brushes on said conductive member arranged to make direct contact with the windscreen.

6. Apparatus as claimed in claim 1 in which said electrically conductive member has charge collecting means arranged so as to be spaced from the windscreen by an air gap sufficiently small as to ionise at a voltage less than that required to cause insulation breakdown of the windscreen material.

7. Apparatus as claimed in claim 6 in which said blade has its edge serrated so as to provide a series of sharply pointed projections.

8. Apparatus as claimed in claim 5 in which the charge collecting means comprises a channel of conductive material and means for supplying pressurised air into said channel so as to lift its edges from the surface of the windscreen.

9. Apparatus as claimed in claim 8 further comprising a brush having conductive bristles supported in the channel.

* * * * *